US005946020A

United States Patent [19]

Rogers et al.

[11] Patent Number: 5,946,020

[45] Date of Patent: Aug. 31, 1999

[54] METHOD AND APPARATUS FOR THE MAXIMIZATION OF PRINT QUALITY IN A MULTIPASS THERMAL PRINTER RIBBON

[75] Inventors: Thomas A. Rogers, Williamsville, N.Y.; Joel A. Schoen, Woodinville; Christopher A. Wiklof, Everett, both of Wash.

[73] Assignee: Intermec Corporation, Everett, Wash.

[21] Appl. No.: 08/626,889

[22] Filed: Apr. 3, 1996

[51] Int. Cl.[6] ..... B41J 2/36

[52] U.S. Cl. ..... 347/193; 347/191

[58] Field of Search ..... 347/191, 192, 347/193, 195, 188, 217, 211

[56] References Cited

U.S. PATENT DOCUMENTS

| | | | |
|---|---|---|---|
| 4,783,667 | 11/1988 | Brooks | 347/195 |
| 5,483,273 | 1/1996 | Fujimoto et al. | 347/195 |
| 5,519,426 | 5/1996 | Lukis et al. | 347/211 |
| 5,661,514 | 8/1997 | Lukis et al. | 347/211 |
| 5,682,504 | 10/1997 | Kimura et al. | 347/180 |
| 5,719,615 | 2/1998 | Hashiguchi et al. | 347/195 |

*Primary Examiner*—Robert E. Nappi
*Assistant Examiner*—Y. J. Han
*Attorney, Agent, or Firm*—Seed and Berry LLP

[57] ABSTRACT

A method and apparatus for maximizing print quality in a thermal printer uses a ribbon condition monitor to detect the condition of a multipass thermal ribbon. Data related to the condition of the thermal ribbon at each individual pixel is used to determine a custom energization signal for each thermal print element. In one embodiment, the system utilizes a history memory to track the prior heating history of each thermal print element and an ink memory to track the prior use of each location on the thermal print ribbon corresponding to the thermal print elements. The data from the history memory and the ink memory are combined to form an index to a table memory containing data corresponding to a plurality of energization signal levels for a particular print medium. The data in the table memory provides the custom energization signal for each of the thermal print elements. In an alternative embodiment, a light source and detector are used to determine the thickness of ink remaining on the thermal ribbon. The energization signal is adjusted to compensate for variations in the thickness of the thermal ribbon. In yet another embodiment, data is encoded at one end of a multipass thermal ribbon. The encoded data provides information related to the amount of usage of the thermal ribbon. The energization signal may be boosted for pixels along the edge of a graphic image so as to maximize the contrast of image edges. The system determines whether a particular pixel is located at the edge of a graphic image area and adjusts the energization signal correspondingly.

12 Claims, 5 Drawing Sheets

METHOD AND APPARATUS FOR THE MAXIMIZATION OF PRINT QUALITY IN A MULTIPASS THERMAL PRINTER RIBBON

TECHNICAL FIELD

The present invention relates generally to thermal printing and, more specifically, to a method and apparatus for the maximization of print quality in a multipass thermal ribbon.

BACKGROUND OF THE INVENTION

A typical thermal printer creates marks on a print medium by selectively heating elements within a thermal printhead to cause the transfer of ink from a thermal printer ribbon to the print medium.

As seen in FIG. 1, a conventional thermal printhead 2 used for bar-code printing typically comprises an array of small thermal print elements 2*a,* each of which produces heat in response to an electrical input signal. The smallest element that can be printed, termed a pixel, is dependent on the size of the thermal print elements 2*a*. Each thermal print element 2*a* is typically a resistive strip of thermal material through which an electrical current is passed. In some thermal printer applications, such as a bar code thermal printer, the thermal print elements 2*a* are arranged in a linear array four to six inches wide with 800–1200 thermal print elements in a 1×800 or 1×1200 array. In such applications, the thermal printhead 2 is stationary and a print medium 6 moves past the thermal printhead.

In a typical bar code thermal printer, the print medium 6 moves in a transverse direction past the thermal printhead 2 containing the linear array of thermal print elements 2*a*. The print medium 6 is in thermal contact with the thermal print elements 2*a* as it is moved past the thermal printhead 2 in a stepwise fashion. During each step, desired thermal print elements 2*a* are selectively heated and portions of the print medium 6 in thermal contact with the heated thermal print elements are darkened from ink transferred from a thermal printer ribbon 4 to the print medium.

The print medium 6 is in thermal contact with the thermal printhead 2 for a predetermined period of time designated as a scan line time, or SLT. A given SLT may be further broken down into multiple time segments, allowing portions of the SLT to be processed separately. In a typical thermal printhead 2, a print command signal is input to each thermal print element 2*a* selected to print during a particular SLT. The print command signal is designed to raise the temperature of the thermal print element 2*a* to a prescribed temperature and to maintain the temperature level for a prescribed time. In its most simple form, the print element is energized at a constant level during the entire SLT if printing is desired, and is not energized at all if no printing is desired.

It is well known in the art that the ambient temperature of the thermal printhead 2 can affect the quality of the printing. For example, if the thermal printhead 2 has a relatively high ambient temperature, the image transferred to the print medium 6 appears to be enlarged relative to the same image printed with the thermal printhead 2 at a relatively low ambient temperature. This effect is due to the residual heat of the thermal print elements 2*a* causing the transfer of an excessive amount of ink from the thermal printer ribbon 4 to the print medium 6.

In more sophisticated thermal printers, the print command signal is a logical AND combination of data signal and a strobe signal. The logical AND of the data signal and the strobe signal controls whether or not thermal print element 2*a* will be heated at any particular time. This signal will be referred to herein as an energization signal. It is known in the art to use the strobe signal to compensate for variations in the ambient temperature of the thermal printhead 2 over a relatively long period of time. For example, when the thermal printer initially begins operation, the ambient temperature of the thermal printhead 2 is relatively low. Thus, the strobe signal may be longer in duration to allow the proper transfer of heat to the thermal print elements 2*a* to transfer a desired amount of ink from the thermal printer ribbon 4 to the print medium 6. As the ambient temperature of the thermal printhead 2 increases during the course of a print job or during the day, the strobe signal may be altered so as to transfer less energy to the thermal print elements 2*a* in order to transfer the same desired amount of ink from the thermal printer ribbon to the print medium 6. If no such compensation were incorporated, pixels printed during the warm-up period would be lighter than desired due to insufficient heat being transferred to the print element 2*a* during the SLT. After the printhead is warmed up, the pixels would be darker than desired due to the residual heat in each print element 2*a*.

Even with the long-term compensation for the ambient temperature of the thermal printhead 2, thermal printers of the prior art cannot compensate for changes in the quality of the thermal printer ribbon 4 itself. In a multipass thermal printer ribbon 4, the print quality is affected by the number of times in which the thermal printer ribbon 4 is used, as well as the amount of ink transferred from the thermal printer ribbon to the print medium 6 during previous passes. For example, FIG. 1 illustrates the transfer of a portion 8*a* of ink from the thermal printer ribbon 4 to the print medium 6. The thermal printer ribbon 4 has a corresponding indentation 8*b* where ink from the thermal printer ribbon was transferred to the print medium 6. Thus, the print quality is affected by the amount of ink removed from the thermal printer ribbon 4 in previous passes.

Previous efforts to improve multipass thermal ribbon technology have focused on changing the chemical and physical composition of the ribbon itself. Therefore, it can be appreciated that there is a significant need for a thermal printer that can compensate for variations in the multipass thermal printer ribbon in order to maximize the print quality. The present invention provides this and other advantages as will be seen by way of the accompanying drawings and detailed description.

SUMMARY OF THE INVENTION

The present invention is embodied in a system and method for controlling operation of a thermal printer. The thermal printer contains a thermal printhead with a plurality of thermal print elements positioned proximate to a printing site wherein a print medium on which printing is to appear is also positioned proximate to the printing site. The thermal print assembly comprises a multipass thermal printer ribbon containing a predetermined quantity of ink thereon, with the thermal ribbon being positioned proximate the thermal print elements and the printing site to transfer a portion of the ink to the print medium at the printing site in response to the selective heating of the thermal print elements. A ribbon condition monitor determines a quantity of the ink remaining on the ribbon at a particular location on the ribbon and an energization controller, responsive to the ribbon condition monitor, generates a control signal for at least one of the thermal print elements to control printing at the particular location, with the control signal varying with the determined quantity of ink remaining on the ribbon.

In one embodiment, the system further includes a history memory containing history data indicative of the past usage of the at least one thermal print element during the previous period of time. The energization controller using the history data and the ribbon condition monitor to generate the control signal for the at least one thermal print element. The system may also include a table memory containing data with a plurality of energization levels indicative of a characteristic of the print medium. The energization controller uses data from the ribbon condition monitor as an index to a particular location in the table memory, with the particular location containing data used to generate the control signal.

In one alternative embodiment, the ribbon condition monitor includes a light source positioned on a first side of the thermal printer ribbon to direct light through the ribbon. A light detector positioned on the second side of the ribbon opposite the light source detects at least a portion of the light transmitted through the ribbon and generates a signal indicative of an intensity of the transmitted light. The ribbon condition monitor receives the signal and determines the quantity of ink remaining on the ribbon based on the intensity of transmitted light. Alternatively, the light source and detector may be positioned on the same side of the ribbon with the light source directing light on to the ribbon and the light detector detecting light reflected from the ribbon. The light detector generates a signal indicative of the intensity of the reflected light, and the ribbon condition monitor receives the signal and determines the quantity of ink remaining on the ribbon based on the intensity of the reflected light.

In another alternative embodiment, the ribbon condition monitor comprises an ink memory to store data indicative of the usage of the ribbon at a location corresponding to the particular location on the ribbon. The ink memory may be sized to correspond to the plurality of print elements such that the stored data in the ink memory is indicative of usage of the ribbon at each of the plurality of print elements.

In yet another embodiment, the ribbon has first and second ends with an image portion positioned at the second end, wherein the ribbon condition monitor detects the image portion to determine usage of the ribbon. The system may also include a display visible to the user to indicate the usage of the ribbon.

In yet another embodiment, the thermal printer selectively heats print elements using a predetermined signal to transfer heat form the ribbon to the print medium. The image to be transferred to the print medium has an edge portion that is printed at the printing site and adjacent to a portion of the print medium on which no printing occurs. The energization controller generates a control signal to selectively alter the predetermined signal for at least one of the thermal print elements based on the position of the thermal print element at the edge portion or at a position away from the edge portion. In one embodiment the control signal is selectively increased from the predetermined signal when the thermal print element is at the edge portion. Alternatively, the energization controller may selectively decrease the predetermined signal when the thermal print element is at a location within the printing site and spaced apart from the edge portion.

DETAILED DESCRIPTION OF THE INVENTION

Figure 1:
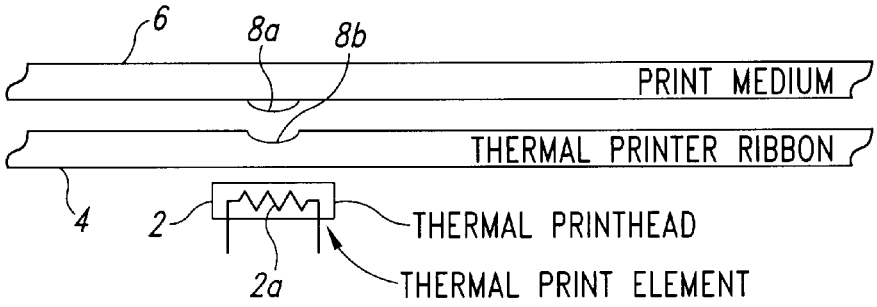
Fig. 1 (Prior Art)
FIG. 1 illustrates a conventional thermal printhead with a multipass thermal printer ribbon.

Thermal printing in its simplest form requires the heating of a thermal print element 2*a* (see FIG. 1) to cause the transfer of ink from a thermal printer ribbon 4 to a print medium 6. As previously discussed above, thermal printing in this simple form produces undesirable results because of changes in the ambient temperature of the thermal printhead 4 and thus in the thermal print elements 2*a*. The use of the strobe signal to compensate for long-term variations in the ambient temperature of the thermal printhead is also discussed above.

A technique for the adaptive energization of heating elements in response to conditions affecting each individual thermal print element 2*a* is described in U.S. patent application Ser. No. 07/830,310, filed Jan. 31, 1992 and incorporated herein by reference in its entirety. In the above-referenced patent application, a history memory tracks the energization of each thermal print element 2*a* in the thermal printhead 2 for a predetermined period of time. Each thermal print element 2*a* within the thermal printhead 2 can receive a customized energization signal based on the past usage of the particular thermal print element. While this technique provides element-by-element compensation for variation in temperature based on past usage, a substantial amount of memory is required to provide an adequate history for each of the thermal print elements 2*a*.

A technique for the compression of data in the history memory is described in U.S. patent application Ser. No. 08/172,859, filed on Dec. 23, 1993, which is incorporated herein by reference in its entirety. The technique described in this patent application uses a lossy compression technique to reduce the memory requirements for the history memory. Thus, the heating history of each thermal print element 2*a* within the thermal printhead 2 may be tracked without requiring a significant amount of memory. The energization level of each thermal print element 2*a* in the thermal printhead 2 is customized in light of the thermal print history for each thermal print element.

While the above-described techniques provide compensation for past heating history of each individual thermal print element 2*a* within the thermal printhead 2, such techniques do not compensate for variations in the multipass thermal printer ribbon 4 itself. Less heat is required to transfer a given amount of ink from the thermal printer ribbon 4 to the print medium 6 if the particular portion of the thermal printer ribbon has previously been used to transfer ink. That is, the more a thermal printer ribbon has been used, the less energy is required to transfer an equivalent amount of ink to the print medium. Those skilled in the art will understand that no amount of heat will cause the transfer of an adequate amount of ink when the thermal printer ribbon 4 has been used for several passes and does not have a sufficient amount of ink remaining on the thermal printer ribbon.

The present invention provides compensation for the past usage of the thermal printer ribbon 4, as well as the past heating history of each thermal print element 2*a* within the thermal printhead 2. The present invention further provides custom energization levels for each thermal print element 2*a*, depending on the condition of the thermal printer ribbon 4 at that specific location, the past heating history of the particular thermal print element 2*a*, and the energy delivered to thermal print elements located along an edge of an image area on the print medium 6.

Figure 2:
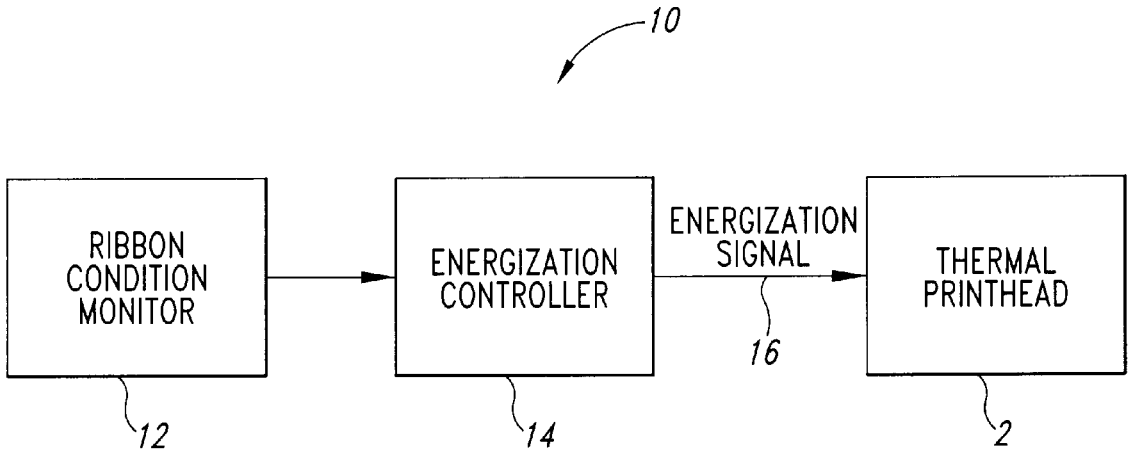
FIG. 2 is a functional block diagram of a thermal printer according to the principles of the present invention.

The present invention is incorporated into a system 10 shown in a functional block diagram of FIG. 2. The system 10 uses a ribbon condition monitor 12 to determine the condition of the thermal printer ribbon 4 at the printing site. Various embodiments of the ribbon condition monitor 12 are described below. Data generated by the ribbon condition monitor 12 is supplied to an energization controller 14. The energization controller 14 generates a customized energization signal 16 to selectively heat each thermal heating element 2*a* within the thermal printhead 2. Various embodiments of the energization controller 14 are also described below.

Thus, the system 10 determines the condition of the thermal printer ribbon 4 and adjusts the energization signal 16 to compensate for variations in the condition of the thermal printer ribbon. The system 10 can operate with various types of thermal printer ribbon technologies. For example, the system 10 can compensate for variations in the condition of the thermal printer ribbon 4 in normal or stretch ribbon printers. The term "stretch ribbon" refers to printer systems in which the ratio of ribbon speed to paper speed is altered to "stretch" the ribbon usage. The thermal printer ribbon 4 moves, for example, at one-half the paper speed which results in greater ink usage in a single pass of the thermal printer ribbon.

Figure 3:
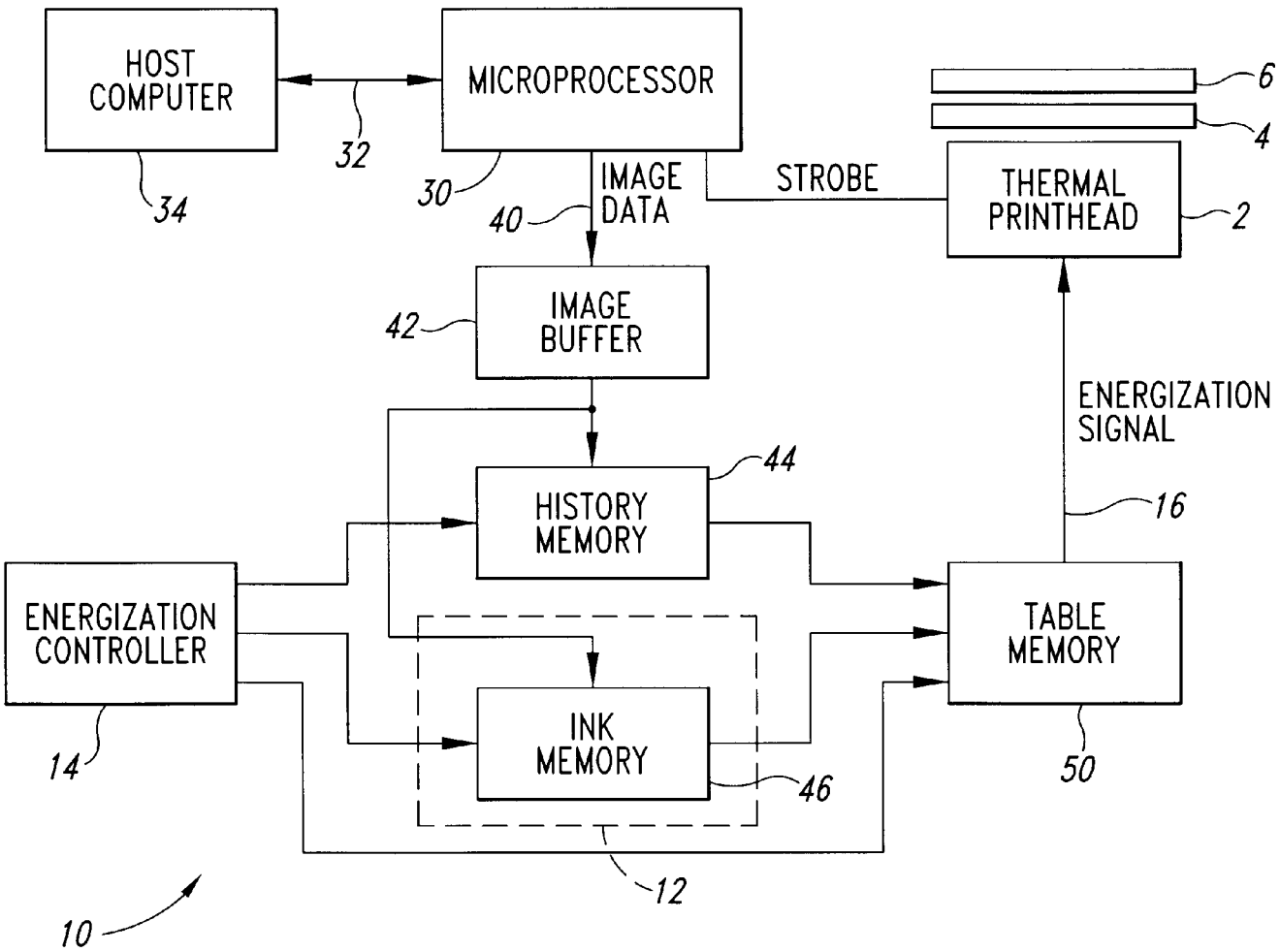
FIG. 3 is a functional block diagram of one embodiment of the thermal printer of FIG. 2.

In one embodiment of the system 10, shown in the functional block diagram of FIG. 3, the system includes a microprocessor 30 to control the thermal printing process. The microprocessor 30 may be coupled to a host computer 34 via a conventional interface 32, such as a serial port, a parallel port, a network connection, or the like. The host computer 34 may download data related to the image to be printed, as well as data related to the print medium 6. The microprocessor 30 contains data related to the desired image and the print medium 6. Image data is transferred from the microprocessor 30 to an image buffer 42 by an image data line 40. The image buffer 42 typically contains a bitmap related to the graphic image, and is sized to contain at least a portion of the image data related to the graphic image to be printed on the print medium 6. Alternatively, the image buffer 42 may be sized to contain the entire bitmap data file related to the graphic image. Typically, each data bit in the image buffer 42 corresponds to a pixel. The image buffer 42 may be organized to correspond to the size of the thermal printhead 2, as well as the SLT. For example, the image buffer 42 may be organized into columns and rows where each row corresponds to an SLT, and each column corresponds to a particular thermal print element 2*a* in the thermal printhead 2.

The data within the image buffer 42 is passed to a history memory 44. As described in U.S. patent application Ser. No. 07/830,310, the history memory 44 tracks the usage of each thermal print element 2*a* for a predetermined number of previous SLTs. As previously discussed, the more a particular thermal print element 2*a* within the thermal printhead 2 has been activated in previous SLTs, the less energy is required to activate that particular thermal print element 2*a* in subsequent SLTs in order to achieve the desired print quality.

The ribbon condition monitor 12 includes an ink memory 46 to compensate for variations in usage of the multipass thermal printer ribbon 4. As discussed above, the greater the usage of the thermal printer ribbon 4 at a particular location on the thermal printer ribbon, correspondingly less heat is required to transfer the same amount of ink in a subsequent SLT. The ink memory 46 operates in a similar manner to the history memory 44, but keeps track of the history of ink usage instead of the past history of heating of each thermal print element 2*a* in the thermal printhead 2. Thus, the ink memory 46 tracks the ink usage of each location on the thermal printer ribbon 4 corresponding to a pixel for each pass of the multipass thermal printer ribbon. In one embodiment, the ink memory 46 has sufficient memory capacity to track the entire history of a multipass thermal printer ribbon 4 through a plurality of passes. Typically, the multipass thermal printer ribbon 4 is used four to six passes before being replaced. Alternative embodiments of the ribbon condition monitor 12 are discussed below.

The history memory 44 and the ink memory 46 are used as indices to a table memory 50. The table memory 50 contains data corresponding to a plurality of energization levels for each particular print medium 6. The table memory 50 may be a read-only memory (ROM) containing data corresponding to all energization levels for a plurality of types of print medium 6. Alternatively, the host computer 34 may download data to the table memory 50 to correspond to the plurality of energization levels for the selected type of print medium 6. In this application, the table memory 50 would be a random access memory (RAM). The data from the table memory 50 for each thermal heating element 2*a* controls the level of an energization signal 16 supplied to the thermal printhead 2 for that particular thermal heating element.

For each pixel in an SLT, the image buffer 42 transfers data to the history memory 44 and the ink memory 46. The history memory 44 provides data regarding the past usage of each thermal print element 2*a* in the thermal printhead 2, while the ink memory 46 provides data indicating past usage of the thermal printer ribbon 4 at locations corresponding to the thermal print elements 2*a* for that particular SLT. The data from the history memory 44 is combined with data from the ink memory 46 to provide an index to the table memory 50 and indicate a particular location within the table memory. The data within the particular location in the table memory 50 corresponds to the selected energization level for that particular pixel, and thus provides a customized energization signal for each thermal print element 2*a* that compensates for past usage of each particular thermal print element 2*a* and for past usage of each particular location on the thermal printer ribbon 4. In this manner, the print quality is maximized on a pixel-by-pixel basis by customizing the energization signal 16 for each thermal print element 2*a*.

The system 10 can keep track of ink usage using the ink memory 46, as described above. The size of the ink memory 46 can be reduced using conventional data compression techniques. These data compression techniques are well known to those of ordinary skill in the art and will not be discussed herein.

Even with data compression, the ink memory 46 stores a substantial quantity of data. Alternative embodiments of the ribbon condition monitor 12 minimize the size of the ink memory 46 or do not utilize the ink memory at all. For example, the ink memory 46 is particularly well suited to reversible thermal printer ribbons 4. One well known technique used with reversible thermal printer ribbons 4 is to retract or rewind the thermal printer ribbon in between labels or other print medium 6. For example, after printing a label, the printer (not shown) retracts the thermal printer ribbon 4 three-fourths of the distance of the label. When the next label is printed, three-fourths of the thermal printer ribbon 4 is reused. The net effect of printing and retracting three-fourths of the distance is that each portion of the thermal printer ribbon 4 is used four times. Once a portion of the thermal printer ribbon 4 has been used four times, the ink memory 46 need not store data related to the ink usage on that portion. Thus, the overall size of the ink memory 46 is reduced.

Figure 4A:
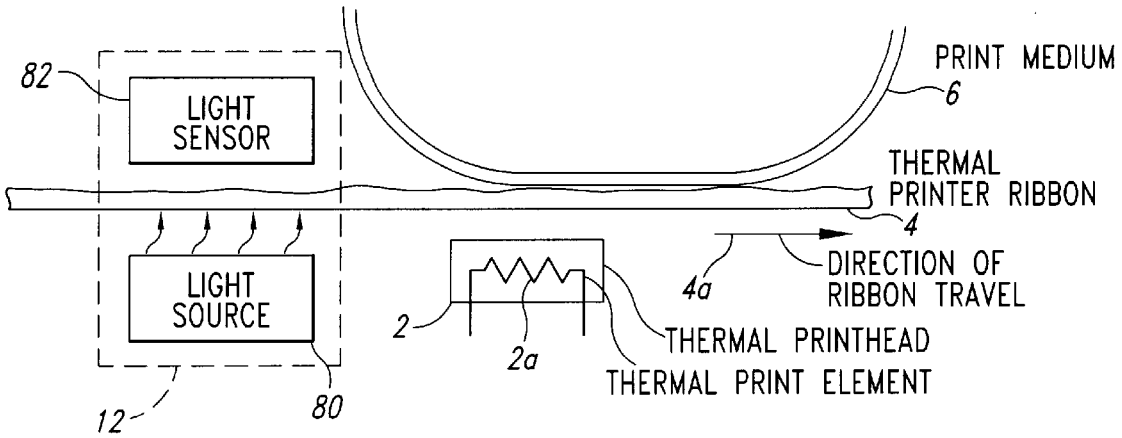
FIG. 4A is a functional block diagram of another embodiment of the thermal printer of FIG. 2.

One alternative embodiment of the ribbon condition monitor 12, illustrated in FIG. 4A, includes a dynamic analysis of the condition of the thermal printer ribbon 4 to determine the thickness of ink on the thermal printer ribbon. The dynamic analysis of the condition of the thermal printer ribbon 4 is performed on a pixel-by-pixel basis such that the condition of the thermal printer ribbon at each pixel corresponding to each of the thermal heating elements 2*a* is analyzed. The energization controller 14 can dynamically adjust the energization signal 16 for each of the heating elements 2*a* to compensate for variations in the thickness of the thermal printer ribbon 4 at the location corresponding to each of the heating elements.

As the portion 8*a* (see FIG. 1) of ink is transferred from the thermal printer ribbon 4 to the print medium 6, the thickness of the ink remaining on the thermal printer ribbon is reduced by a corresponding amount, resulting in the corresponding indentation 8*b* in the thermal printer ribbon. This decrease in the relative thickness of the ink on the thermal printer ribbon 4 can be detected by transmitting light through the thermal printer ribbon.

The ribbon condition monitor 12 of FIG. 4A includes a light source 80 positioned on a first side of the thermal printer ribbon 4 and a light sensor 82 positioned on the opposite side of the thermal printer ribbon. Light source 80 and the light sensor 82 are positioned away from the thermal printhead to allow convenient detection of the condition of the thermal printer ribbon 4. As is known in the art, the thermal printer ribbon 4 has a direction of ribbon travel indicated by the arrow having the reference numeral 4*a*. The light source 80 and light sensor 82 are positioned such that the thermal printer ribbon travels between the light source and the light sensor prior to passing between the thermal printhead 2 and the print medium 6. Thus, the ribbon condition monitor 12 detects the condition of the thermal ribbon 4 at a particular location prior to that particular location being used in subsequent printing by the thermal printhead. In this embodiment, the ink memory 46 (see FIG. 3) is used to temporarily store data for the particular location of the printer ribbon until that particular portion of the printer ribbon passes by the thermal printhead. In this embodiment, the size of the ink memory is greatly reduced because it is only necessary to store data for the portion of the thermal printer ribbon 4 the period of time it takes for the thermal printer ribbon to pass from the position of the light source 80 and the light sensor 82 to the thermal printhead 2.

As can be readily appreciated by those of ordinary skill in the art, the size of the ink memory 46 is related to the distance between the light source 80 and the thermal printhead 2. If the light source 80 and the light sensor 82 were positioned at the same location as the thermal printhead 2, no ink memory 46 would be required.

Many thermal printers have a unidirectional travel ribbon 4. When the multipass thermal ribbon reaches the end, the user reverses the cartridge. Alternatively, some thermal printers actually reverse the direction of ribbon travel for a period. If the thermal printer ribbon is bi-directional, a second light source 80 and light sensor 82 would be positioned on the opposite side of the thermal printhead than that shown in FIG. 4A. In this manner, the system 10 can detect the condition of the thermal printer ribbon prior to its passage between the thermal printhead 2 and the print medium 6.

Figure 4B:
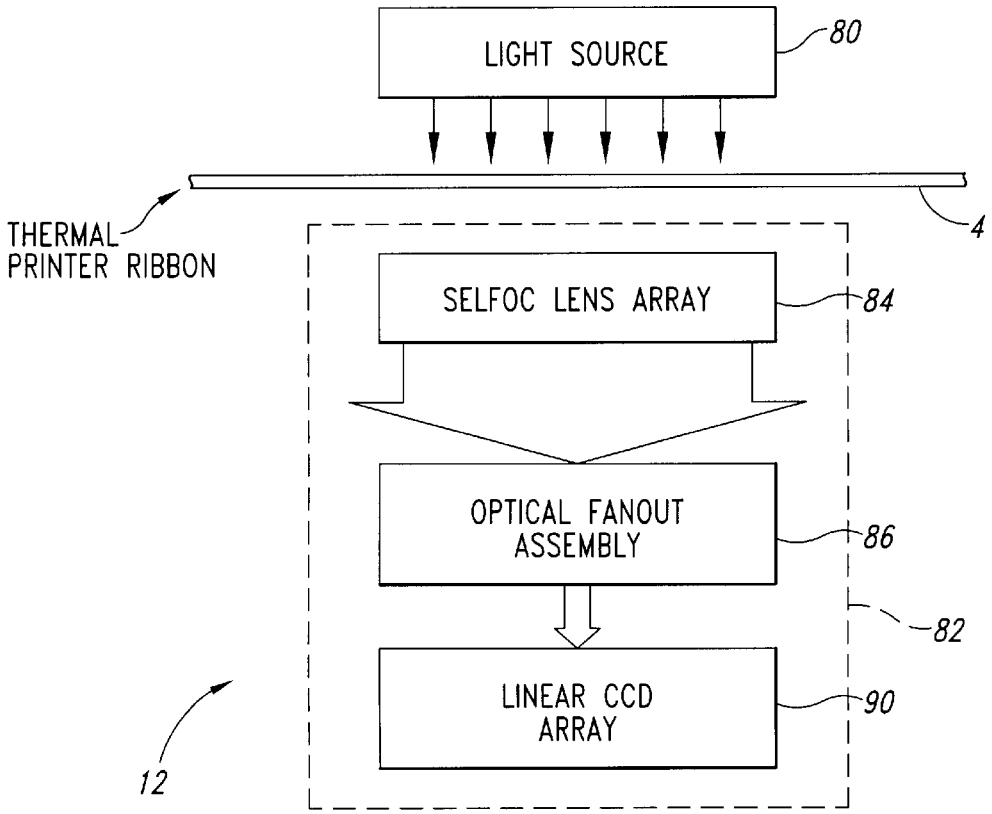
FIG. 4B illustrates the light assembly used by the thermal printer of FIG. 4A.

Details of the light source 80 and light sensor 82 are shown in FIG. 4B. The light source 80 is positioned on one side of the thermal printer ribbon 4 and directs light through the thermal printer ribbon. On the opposite side of the thermal printer ribbon 4, a SELFOC lens array 84 is positioned to collect light transmitted from the light source 80 through the thermal printer ribbon 4. The light source 80 is a conventional light source, such as light emitting diodes (LEDs), bar lights, conventional lamp, or the like and is sized to correspond to the length of the thermal printhead 2 (see FIG. 3). The light source 80 and light sensor 82 are arranged transverse to a longitudinal axis of the thermal printer ribbon 4. The SELFOC lens array 84 is a conventional component and also has a size corresponding to the length of the thermal printhead 2. The light transmitted through the thermal printer ribbon 4 and collected by the SELFOC lens array 84 is coupled to an optical fanout assembly 86. The optical fanout assembly 86 is a conventional optical component with an input image area having first size and an output image area having a different second size. The input area of the optical fanout assembly 86 corresponds to the area of the SELFOC lens array 84 and the output area corresponds to the area of a linear charge-coupled device (CCD) array 90. The output of the optical fanout assembly 86 is coupled to the linear CCD array 90, which has a smaller detection area than the area of the light source 80 and the area of the SELFOC lens array 84. Thus, light is transmitted from the light source 80 through the thermal printer ribbon 4 and is collected by the SELFOC lens array 84, compressed in size by the optical fanout assembly 86, and detected by the linear CCD array 90.

The data from the linear CCD array 90 is used by the energization controller 14 to determine a memory location within the table memory 50 (see FIG. 3) to select an energization level from the table memory as the energization signal 16 for each thermal print element 2*a*. Thus, the energization signal 16 for each of the thermal print elements 2*a* is customized to compensate for variations in the condition of the thermal print elements as well as variations in the condition of the thermal printer ribbon 4 at a location corresponding to each of the heating elements. Because the light source 80 and light sensor 82 dynamically sense the condition of the thermal printer ribbon, the system embodied in FIG. 4 does not require the ink memory 46 (see FIG. 3), except for temporary storage as noted above. As those skilled in the art can appreciate, light transmittance and light reflectance are related. In an alternative to the embodiment shown in FIG. 4A, the light sensor 82 can be on the same side of the thermal printer ribbon 4 to detect the amount of light reflected from the thermal printer ribbon and thereby determine the quantity of ink remaining on the thermal printer ribbon.

Figure 5A:
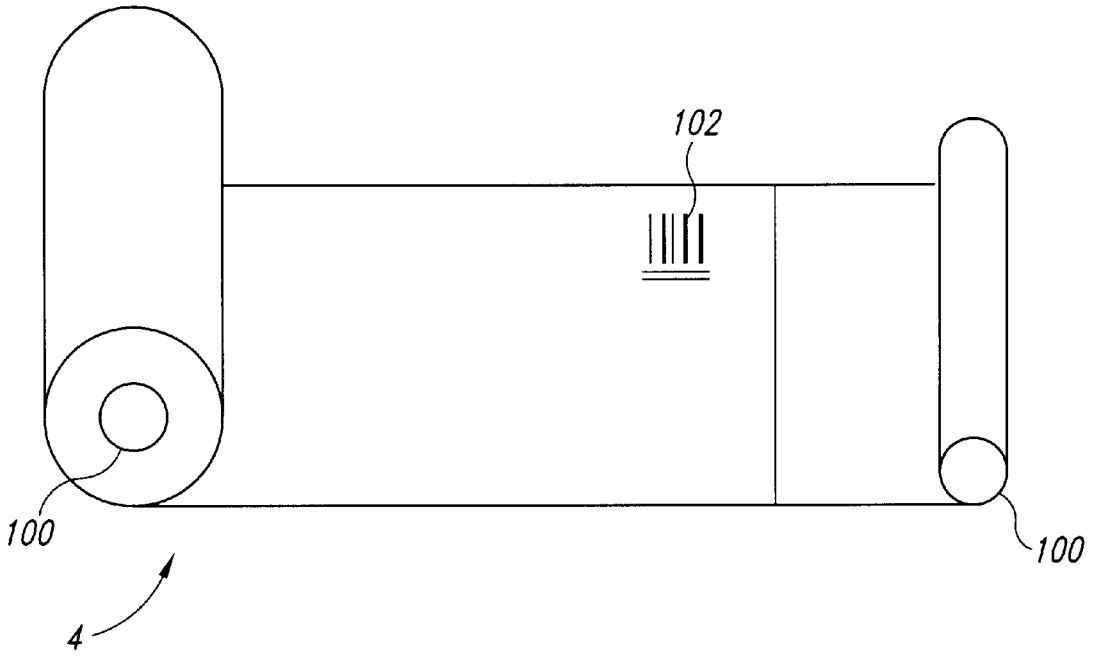
FIG. 5A illustrates a roll of print medium with an indicator used in another embodiment of the thermal printer of FIG. 2 to detect the number of passes of the multipass thermal printer ribbon.
Figure 5B:
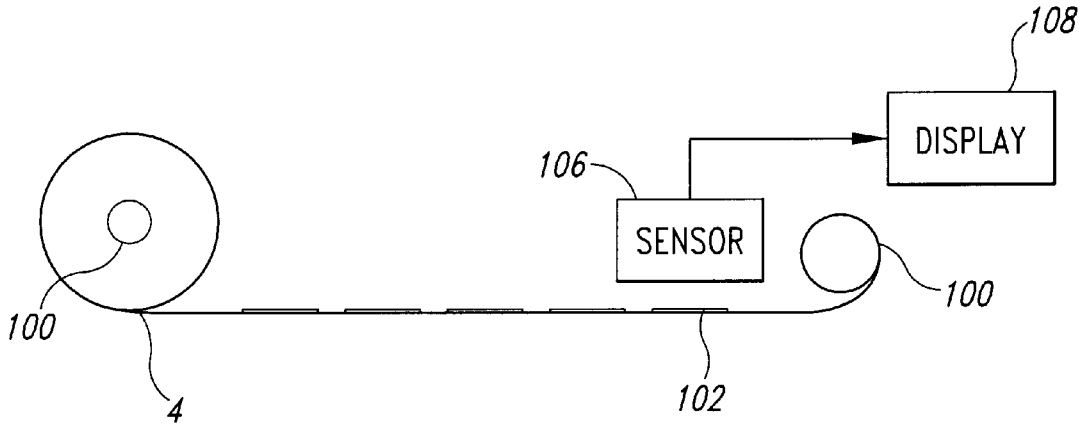
FIG. 5B illustrates a sensor to detect the indicator of FIG. 5A.

In yet another alternative embodiment, the thermal printer ribbon 4 has first and second ends, each attached to a spindle 100, as shown in FIG. 5A. The thermal printer ribbon 4 includes encoded data 102 such as the serial number of the thermal printer ribbon, affixed to one end of the thermal printer ribbon 4. The encoded data 102 may be a bar code or other type symbology, numeric code, or the like. The encoded data 102 is detected by a sensor 106, shown in FIG. 5B, and the data detected by the sensor is transferred to a display 108 visible to the user. Alternatively, the detected data can be transferred to the energization controller 14 (see FIG. 2) to automatically compensate for condition of the thermal printer ribbon 4. While the embodiment of FIGS. 5A–5B does not provide ribbon condition data on a pixel by pixel basis, it can provide data such as the number of passes of the thermal printer ribbon 4 to permit the energization controller 14 to increase the average energization level and thus compensate for the overall use of the thermal printer ribbon. The sensor 106 may be a label gap sensor, a label mark sensor, a ribbon sensor, or the like. These sensors are well known in the art and will not be discussed herein. The display 108 can be any display capable of indicating the encoded data 102. The display 108 could be a counter that merely displays the number of passes of the thermal printer ribbon, or a computer display attached to the microprocessor 30 (see FIG. 3).

Alternatively, the encoded data 102 may be printed on the print medium 6. As is well known in the art, the process of thermal printing transfers ink from the thermal printer ribbon 4 to the print medium 6, with an inverse image of the printed data remaining on the thermal printer ribbon 4. This effect is illustrated in FIG. 1 where the transfer of a portion 8*a* of ink to the print medium 6 causes a corresponding indentation 8*b* in tie thermal printer ribbon 4. As previously discussed, the system 10 is capable of detecting this inverse image by determining the amount of light transmitted through the thermal printer ribbon 4 by the light source 80 (see FIG. 4). Thus, the system 10 is capable of dynamically encoding the encoded data 102 at the end of the thermal printer ribbon 4 such that the encoded data 102 is an inverse image of data printed on the print medium 6. This advantageously allows the system 10 to encode information such as the number of passes of the thermal printer ribbon 4, the number of inches printed, the number of pixels fired, or problems at a particular location in the thermal printer ribbon. For example, a section of the thermal printer ribbon may have undergone heavy use such that there is an inadequate amount of ink left on the thermal printer ribbon 4. The system 10 can identify the exhausted section of the ribbon, thus permitting the system to automatically advance the thermal printer ribbon past the exhausted section.

Figure 6A:
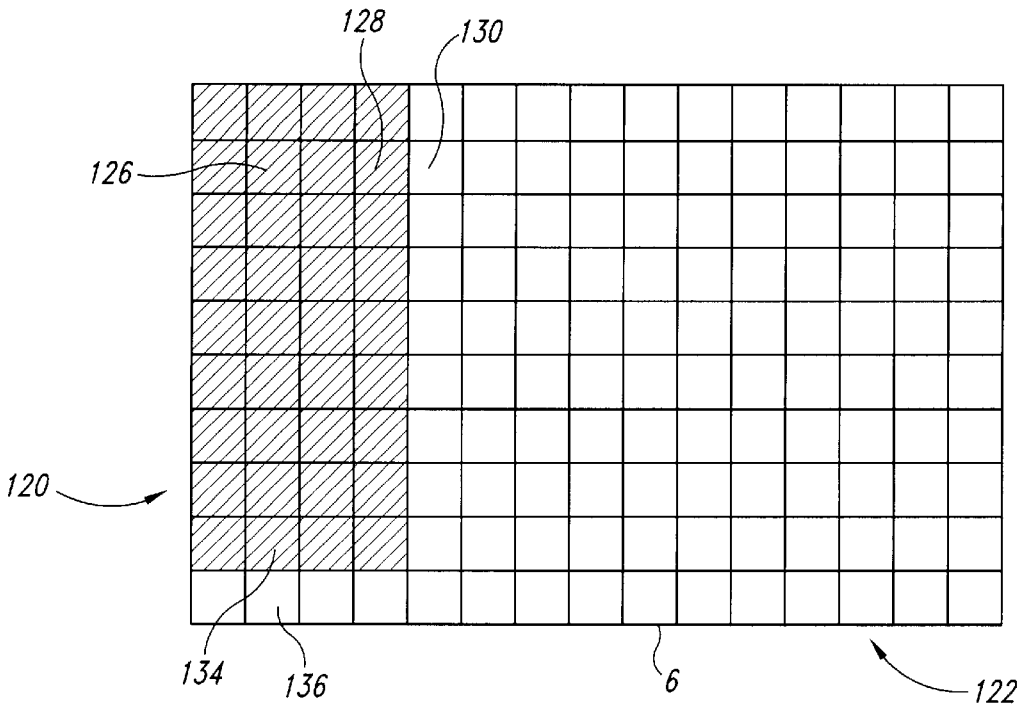
FIG. 6A illustrates the enhancement of pixels along an image edge of a graphic image by the thermal printer of FIG. 2.

In yet another alternative embodiment, the energization controller 14 (see FIG. 3) can provide the custom energization signal 16 to boost the energy delivered to the thermal print elements 2*a* that form the edge of an image. The energization controller 14 may also concurrently decrease the amount of energy for thermal print elements 2*a* for printed pixels that fall within the interior of an image to be printed. This is best illustrated in FIG. 6A where a graphic image 120 on the print medium comprises a plurality of pixels 122, some of which are visible by virtue of ink being transferred to the print medium 6. The visible pixels are referred to herein as printed pixels while pixels to which no ink has been transferred are referred to as unprinted pixels. A printed pixel 126 falls within the interior portion of the graphic image 120 because it is surrounded on all sides by other printed pixels. In contrast, a printed pixel 128 is defined as being along an edge of the graphic image 120 because an unprinted pixel 130 is adjacent to the printed pixel. Similarly, a printed pixel 134 is defined as being along an edge of the graphic image 120 because an unprinted pixel 136 is adjacent to the printed pixel.

Studies have indicated that perceived print quality depends to a large degree on the apparent sharpness of image edges and to a relatively lower degree on the darkness or the center of such images. Apparent edge sharpness is largely governed by the reflective difference of pixels bordering the edge of the graphic image 120. That is, the perceived quality of the graphic image 120 is proportional to the difference in average reflectance of white unprinted pixels adjoining the edge of the graphic image and the average reflectance of black printed pixels adjoining the edge of the graphic image. Similarly, accurate scanning of the graphic image 120 by a machine such as a bar code scanner (not shown) depends to a large degree on the accurate detection of the edge of the graphic image. Therefore, the system 10 enhances the edge of the graphic image while decreasing the amount of ink transferred to the center of the graphic image, resulting in a high quality image while conserving ink on the thermal printer ribbon 4.

As discussed above, when the portion 8*a* (see FIG. 1) of ink is transferred from the thermal printer ribbon 4 to the print medium 6, the inverse image remains on the thermal printer ribbon in the form of the corresponding indentation 8*b*. It is known that when printing a large image area, such as bold alphanumeric characters, or bar codes, the inverse image of such characters tends to show in the printed output on the print medium 6 in subsequent passes of the thermal printer ribbon 4. The system 10 compensates for this effect by boosting the energy of printed pixels along the edge of the graphic image 120 while decreasing the energy for printed pixels within the interior of the graphic image. Boosting energy for printed pixels on the edge of the graphic image 120 improves the perceived quality, as previously discussed, while decreasing the energy for printed pixels within the interior portion of the graphic image conserves ink by reducing the amount of ink used to print the graphic image.

Figure 6B:
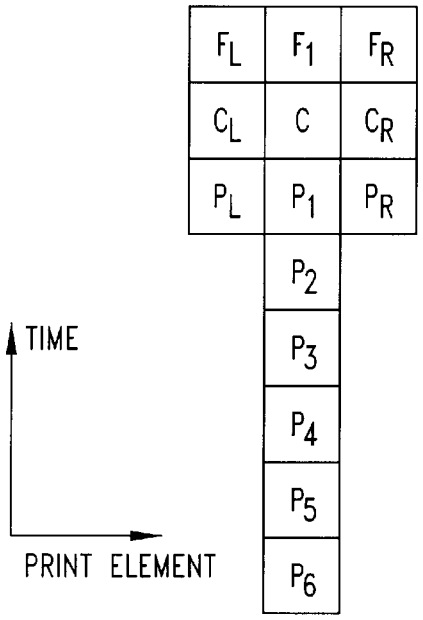
FIG. 6B illustrates the increase in energization signal to pixels along the edge of a graphic image.

As an example of this embodiment of the system 10, consider FIG. 6B, which illustrates a number of pixels in an image. In FIG. 6B, pixels that have been printed in the past have the designation P to indicate that the pixels have already been printed in past SLTs. The current SLT contains pixels having the designation C to indicate that these pixels are in the current SLT. Pixels in a future SLT have the designation F to indicate that the pixels are in a future SLT.

The system 10 analyzes the current pixel C to determine whether it is at the edge of the graphic image 120 (see FIG. 6A). The pixel C is assumed to be at the edge of an image if the future state of the pixel $F_R$ to the right of the current pixel, the future state of the current pixel $F_1$, or the future state of the pixel $F_L$ of the current pixel is at a logic state zero indicating that the thermal print element 2*a* corresponding to that pixel is not energized. Similarly, if the pixel $C_L$ to the left of the current pixel C, the pixel $C_R$ to the right of the current pixel in the current scan line, or the pixels $P_L$, $P_1$, or $P_R$ from the previous scan line are at logic zero, it indicates that the current pixel C is at an edge of the graphic image 120. It should be noted that this description assumes that the graphic image 120 is printed from left to right as the print medium 6 is moved past the thermal printhead 2.

If the current pixel C is determined to be at the edge of the graphic image 120, the energization controller 14 (see FIG.

3) can access a different location in the table memory 50 to increase the energy of the energization signal 16 delivered to the thermal print element 2*a* corresponding to the pixel C. Thus, the energization controller 14 can dynamically increase the amount of energy delivered to the pixel C if the pixel C is at the edge of the graphic image 120.

In contrast, the energization controller 14 can decrease the energy of the energization signal 16 delivered to the thermal print element 2*a* corresponding to the pixel C if the pixel C is within the interior portion of an image.

The energization controller 14 may also take into account the past heating history of the thermal print element 2*a* for the pixel C. This is depicted in FIG. 6B as pixels $P_1$–$P_6$. The history memory 44 (see FIG. 3) contains data corresponding to the previous six SLTs to determine the appropriate energization level for the energization signal 16. As previously discussed, the greater the usage of a particular thermal print element 2*a* in the past, the less energy is required to heat the thermal print element for the current SLT. Similarly, the ink memory 46 can be used to track the usage of ink from the thermal printer ribbon 4 in the manner previously described.

Thus, the system 10 can greatly enhance the quality of the printed image by dynamically adjusting the energy level for each thermal print element 2*a* depending on the past history of the thermal print element, the past history of the thermal printer ribbon 4, and the location of each thermal print element within the graphic image 120. The system 10 also advantageously extends the useful life of the thermal printer ribbon 4 by decreasing the thermal energy delivered to thermal print elements 2*a* within the interior portions of the graphic image 120, thus reducing the quantity of ink transferred to the print medium 6.

It is to be understood that even though various embodiments and advantages of the present invention have been set forth in the foregoing description, the above disclosure is illustrative only, and changes may be made in detail, yet remain within the broad principles of the invention. Therefore, the present invention is to be limited only by the appended claims.

What is claimed is:

1. A thermal printer for printing on a print medium, the thermal printer comprising:

a thermal printhead that includes a plurality of thermal print elements positioned proximate a printing site on the print medium;

a thermal printer ribbon position positioned proximate said thermal print elements and said printing site to transfer ink to the print medium at said printing site in response to selective heating of said thermal print elements above a threshold temperature, said selectively heated print elements receiving a predetermined signal to transfer ink from said ribbon to the print medium;

a data storage area containing print data corresponding to an image to be printed at said printing site on the print medium, said image having an edge portion that is printed at said printing site and adjacent to a portion of the print medium on which no printing occurs and an interior printed portion that is printed at said printing site and different from said edge portion; and an energization controller receiving said print data and generating control signals to control said plurality of thermal print elements, said energization controller selectively altering a portion of said control signals to increase the temperature of a portion of said thermal print elements above said threshold temperature to thereby increase ink transfer to said edge portion.

2. The printer of claim 1 wherein said energization controller selectively alters a portion of said control signals to decrease the temperature of a portion of said thermal print elements while maintaining the temperature above said threshold temperature to thereby decrease ink transfer to said interior printed portion.

3. The printer of claim 1, further including a history memory containing history data indicative of past usage of said at least one thermal print element during a previous period of time, said energization controller using said history data to generate said altered control signals.

4. The printer of claim 1, further including a table memory containing data with a plurality of energization levels and indicative of a characteristic of the print medium, said energization controller using said table memory to generate said control signals.

5. A method using a thermal printer for printing on a print medium, the thermal printer comprising of:

positioning a thermal print head that includes a plurality of thermal print elements proximate a printing site, wherein the print medium on which printing is to appear is also positioned proximate said printing site;

positioning a multipass thermal ribbon position, having ink thereon, proximate the thermal print elements and the printing site to transfer a portion of said ink to the print medium at the printing site in response to the selective heating of the plurality of thermal print elements above a threshold temperature, said selectively heated print elements receiving a predetermined signal to transfer said ink from said ribbon to the print medium;

storing print data corresponding to an image to be printed on the print medium, said image having an edge portion to be printed at said printing site and adjacent to a portion of the print medium on which no printing occurs;

generating a control signal to selectively alter said predetermined signal for at least one of said thermal print elements based on a position of said at least one thermal print element at said edge portion or at a position away from said edge portion wherein said control signal is selectively increased from said predetermined signal when said at least one thermal print element is at said edge portion and is selectively decreased from said predetermined signal when said at least one thermal print element is at a location within said printing site and spaced apart from said edge portion, said decreased signal still selectively heating said at least one thermal print element above said threshold temperature.

6. The method of claim 5, further including the step of using a history memory containing history data indicative of past usage of said at least one of the thermal elements during a previous period of time, and using said history data to generate said control signal.

7. The method of claim 6, further including the step of using said history data as an index to a particular location in a table memory containing data with a plurality of energization levels indicative of a characteristic of the print medium, said particular location containing data used to generate said control signal.

8. A printer system using a thermal printhead for printing on a print medium, the thermal printhead including a plurality of thermal print elements positioned proximate a printing site on the print medium at which printing is to appear and heated above a threshold temperature to transfer ink to the printing site, the system comprising:

a thermal printer ribbon position positioned proximate the thermal print elements and the printing site to transfer ink to the print medium at the printing site in response to selective heating of the thermal print elements above the threshold temperature;

a data storage area containing print data corresponding to an image to be printed on the print medium, said print data comprising a plurality of pixels corresponding to the thermal print elements with edge pixels that are printed at said printing site and are adjacent to a portion of the print medium on which no printing occurs and interior pixels that are printed at said printing site and are not adjacent to the portion of the print medium on which no printing occurs; and an energization controller receiving said print data and generating a control signal to selectively heat the thermal print elements to a predetermined temperature above the threshold temperature for the interior pixels to transfer ink to the printing site corresponding to the interior pixels and to selectively heat the thermal print elements to a temperature greater than said predetermined temperature for the edge pixels to increase the transfer of ink to the printing site corresponding to the edge pixels and thereby enhance the visibility of the edge pixels on the print medium.

9. The system of claim 8 wherein said energization controller selectively decreases said predetermined temperature for said interior pixels while still maintaining said decreased predetermined temperature above the threshold temperature to thereby decrease the transfer of ink to the printing site corresponding to the interior pixels.

10. The system of claim 8, further including a history memory containing history data indicative of past usage of at least one thermal print element during a previous period of time, said energization controller generating a control signal based on said history data to selectively heat said at least one thermal print element.

11. The system of claim 8, further including a table memory containing data with a plurality of energization levels and indicative of a characteristic of the print medium, said energization controller using said table memory to generate said control signals.

12. A method of using a thermal printhead for printing on a print medium, the thermal printhead including a plurality of thermal print elements positioned proximate a printing site on the print medium at which an image is to appear, the method comprising:

positioning a multipass thermal ribbon position, having ink thereon, proximate the thermal print elements and the printing site, the image to be printed at the printing site comprising a plurality of pixels corresponding to the thermal print elements with edge pixels that are printed at said printing site and are adjacent to a portion of the print medium on which no printing occurs and interior pixels that are printed at said printing site and are not adjacent to the portion of the print medium on which no printing occurs;

selectively heating the plurality of thermal print elements to a predetermined temperature above a threshold temperature for the interior pixels to transfer a portion of said ink to the printing site corresponding to the interior pixels; and selectively heating the plurality of thermal print elements to a temperature greater than said predetermined temperature for the edge pixels to transfer an increased portion of ink to the printing site corresponding to the edge pixels and thereby enhance the visibility of the edge pixels on the print medium.

* * * * *